US008573873B2

(12) United States Patent
Kalush

(10) Patent No.: US 8,573,873 B2
(45) Date of Patent: Nov. 5, 2013

(54) FOOD COATING DEVICE

(76) Inventor: Dino John Kalush, Owings Mills, MD (US)

( * ) Notice: Subject to any disclaimer, the term of this patent is extended or adjusted under 35 U.S.C. 154(b) by 387 days.

(21) Appl. No.: 13/024,754

(22) Filed: Feb. 10, 2011

(65) Prior Publication Data

US 2011/0194883 A1 Aug. 11, 2011

Related U.S. Application Data

(60) Provisional application No. 61/303,552, filed on Feb. 11, 2010.

(51) Int. Cl.
*A47B 11/00* (2006.01)

(52) U.S. Cl.
USPC ..... 401/12; 401/11; 118/13; 118/26

(58) Field of Classification Search
USPC ..... 401/9–12, 121, 122, 131; 118/13, 26
See application file for complete search history.

(56) References Cited

U.S. PATENT DOCUMENTS

| | | | | |
|---|---|---|---|---|
| 2,101,075 | A * | 12/1937 | Krag | 222/386 |
| 3,316,922 | A * | 5/1967 | Seidler | 132/75 |
| 6,299,368 | B1 * | 10/2001 | Tavularis | 401/12 |
| 6,430,770 | B1 * | 8/2002 | Glass | 15/104.92 |
| 7,396,176 | B2 * | 7/2008 | Schoemer | 401/12 |

* cited by examiner

*Primary Examiner* — David Walczak
*Assistant Examiner* — Jennifer C Chiang

(57) ABSTRACT

An apparatus for buttering corn includes a tubular member sized to receive an ear of corn, a body with an open end, the body sized to receive the tubular member, and a plunger sized to fit through the tubular member. Another apparatus for buttering corn includes a tubular member sized to receive an ear of corn and having an interior surface textured to adhere to solidified butter and having an open end with an outer flange, a cylindrical body with an open end having an inner diameter larger than an outer diameter of the tubular member and having an outer diameter about the same length as an outer diameter of the outer flange of the tubular member, the body sized to receive the tubular member, a plunger sized to fit through the tubular member, and a cap sized to fit over the outer flange of the tubular member.

20 Claims, 7 Drawing Sheets

FOOD COATING DEVICE

CLAIM OF PRIORITY

This application claims priority to Provisional Patent Application Ser. No. 61/303,552, filed on Feb. 11, 2010, the entire contents of which are hereby incorporated by reference.

TECHNICAL FIELD

This description relates to a food coating device.

BACKGROUND

Foods can be coated with sauces and dressings to enhance their texture and flavor. The culinary use of vegetables, fruits, meats, starches, and other food products can change depending on whether a sauce is selected for a dish. In addition, some sauces and dressings are popular for cultural reasons, e.g., they may have significance in the context of a holiday, special event, or family tradition. There may be many types of sauces that can be used with a given type of food, and many types of food that pair with a given type of sauce.

SUMMARY

In one aspect, an apparatus for buttering corn includes a tubular member sized to receive an ear of corn, the tubular member having an interior surface textured to adhere to solidified butter and having an open end with an outer flange; a cylindrical body with an open end having an inner diameter larger than an outer diameter of the tubular member and having an outer diameter about the same length as an outer diameter of the outer flange of the tubular member, the body sized to receive the tubular member; a plunger sized to fit through the tubular member; and a cap sized to fit over the outer flange of the tubular member.

Embodiments can include one or more of the following features. The apparatus can include a mixture of water and melted butter contained within the body. The body can have a thickness of about 0.19 inches. The cap can have a capacity of about 4 fluid ounces. The body can have a capacity of about 32 fluid ounces. The body can have a length of about 9.25 inches. The tubular member can have a length of about 5.25 inches. The body can have an inner diameter of about 2.63 inches and the tubular member can have an outer diameter of less than about 2.63. The outer flange can extend about 0.19 inches from an outer circumference of the tubular member.

In another aspect, an apparatus for coating food includes a tubular member sized to receive a food item, a body with an open end, the body sized to receive the tubular member, and a plunger sized to fit through the tubular member.

Embodiments can include one or more of the following features. The tubular member can have an interior surface textured to adhere to a food coating. The apparatus can include a mixture of water and a food coating contained within the body. An open end of the tubular member can have an outer flange having an outer diameter about the same length as an outer diameter of the body. The outer flange can extend about 0.19 inches from an outer circumference of the tubular member. The body can have a thickness of about 0.19 inches. The apparatus can include a cap sized to fit over an open end of the tubular member. The cap can have a capacity of about 4 fluid ounces. The tubular member can be an ultra high molecular weight material. The tubular member can be a dishwasher-safe material. The body can be an ultra high molecular weight material. The body can be a dishwasher-safe material. The body can have a capacity of about 32 fluid ounces. The body can have a length of about 9.25 inches. The tubular member can have a length of about 5.25 inches. The body can have an inner diameter of about 2.63 inches and the tubular member can have an outer diameter of less than about 2.63.

In a further aspect, an apparatus for buttering corn includes a tubular member sized to receive an ear of corn and having an interior surface textured to adhere to solidified butter, the tubular member having a length between 4 and 7 inches, a body with an open end having an inner diameter of approximately the same size as an outer diameter of the tubular member, the open end having an outer flange having an outer diameter greater than the inner diameter of the body, and the body sized to receive the length of an ear of corn, the body having a length between 8 and 11 inches and capacity of between 25 and 50 fluid ounces, a plunger sized to fit through the tubular member, and a butter disc holder sized to fit over the open end of the tubular member having a capacity of 3 to 5 fluid ounces, wherein the tubular member, the body, the plunger, and the butter disc holder comprise a dishwasher-safe material.

Advantages can include one or more of the following.

Food coating devices can be used to apply coatings, particularly liquid coatings, that have a specific gravity or density that is different from water. These coatings can be applied quickly and cleanly.

In one embodiment, butter can be applied to an ear of corn in a way that limits spilling butter. Several ears of corn can be buttered in sequence. The device can be washed and re-used many times. The butter used with the device can be collected and stored for re-use at a later time.

Other features and advantages will become apparent from the following description, and from the claims.

DETAILED DESCRIPTION

Figure 1A:
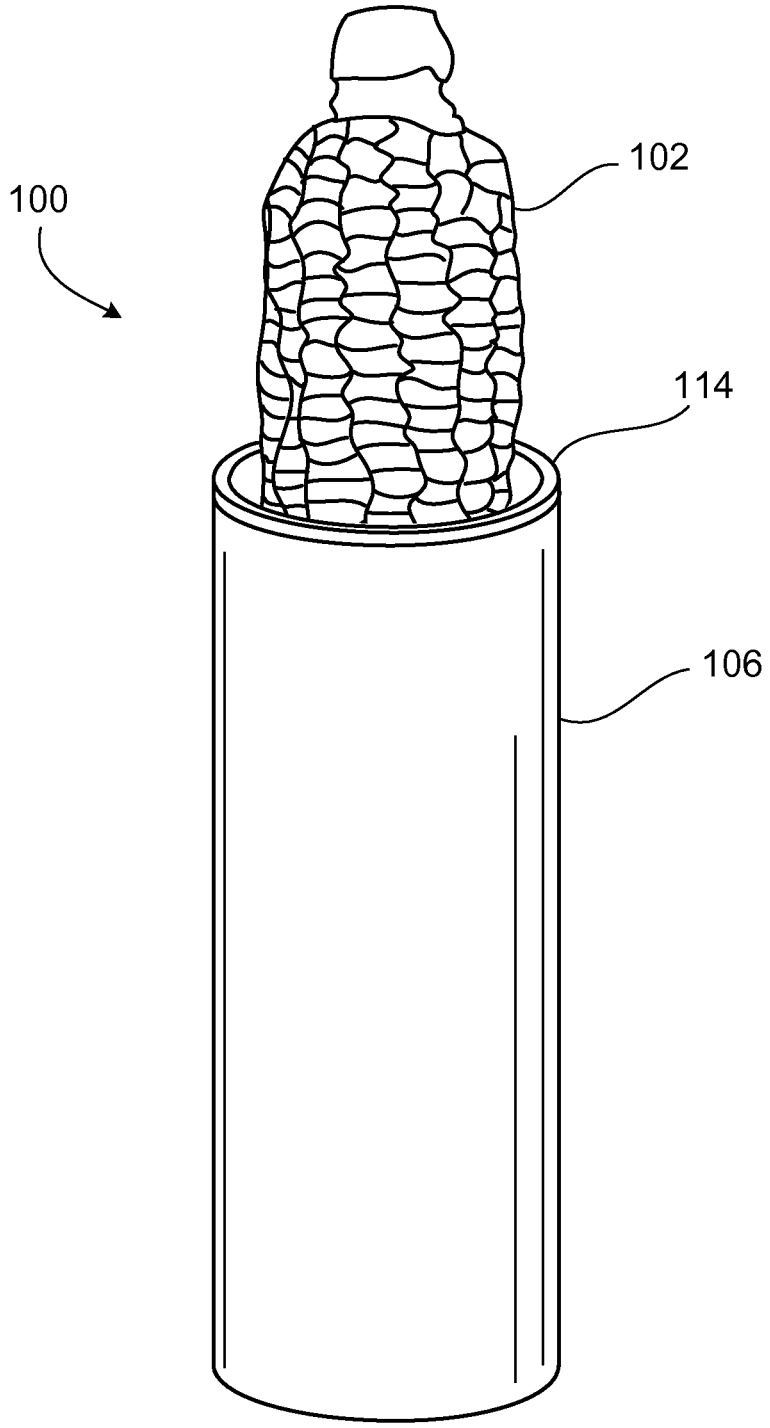
FIGS. 1A and 1B show a food coating device.
Figure 1B:
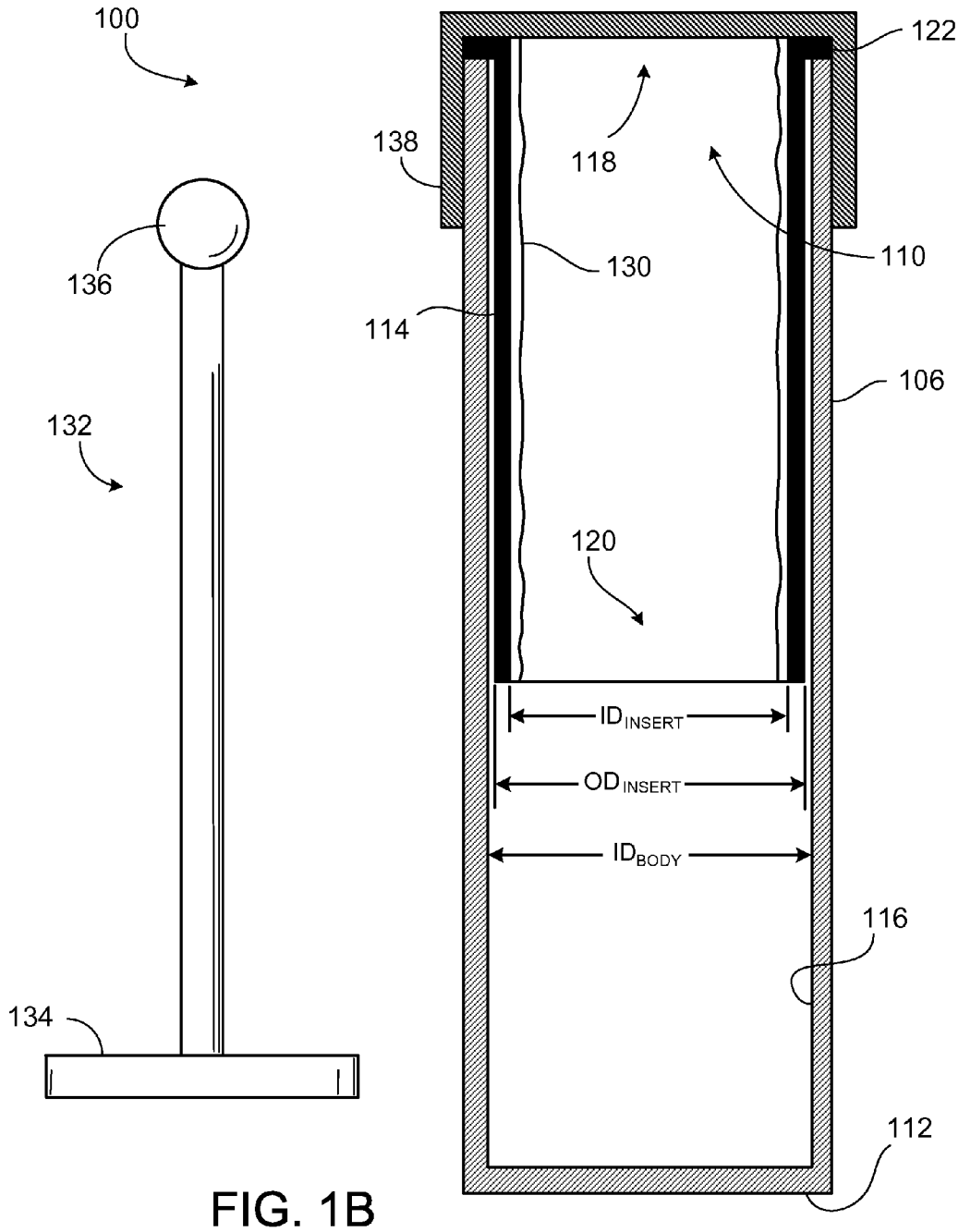

As shown in FIGS. 1A and 1B, a food coating device 100 can be used, for example, to apply butter to an ear of corn 102. The device 100 is configured (e.g., sized and shaped) to be conveniently used for coating ears of corn with butter. The device 100 can be also used to coat types of food other than an ear of corn, and can also be used with coatings other than butter.

The device 100 has a body 106 which receives an insert 114. The body 106 has an open end 110 and a closed end 112. The insert 114 fits inside the body 106 close to the interior surface 116 of the body 106, e.g., an outer diameter ($OD_{insert}$) of the insert 114 can be slightly smaller than an inner diameter ($ID_{body}$) of the body 106. As shown, the outer surfaces of the insert 114 are spaced slightly apart from the inner surfaces of the body 106.

The insert 114 has an open end 118 (e.g., to receive the ear of corn 102) and an opposite second open end 120 (e.g., to allow the ear of corn to pass through while contacting a coating within the device 100). The insert 114 has a flange 122 that extends radially outward at open end 118 of the insert 114. When the insert 114 is placed inside the body 106, the flange 122 engages the body 106 and prevents the insert 114 from entering too far into the body such that the insert can be easily removed by pulling up on the flange. In some examples, the outer circumference of the flange 122 is flush with the outer circumference of the body 106.

In some environments, the insert 114 has a textured inner surface 130. After use, the device 100 can be placed in a cool environment such as a refrigerator or other area at a temperature in which some food coatings will naturally rise above the water contained in the coating device 100 and congeal inside the insert 114. In some instances, such congealed food coatings can adhere to the textured inner surface 130.

The device 100 also has a plunger 132 with a head 134 sized to push solidified butter out of the insert 114. In some embodiments, the plunger 132 can also have a handle 136 that can be gripped by a user. The plunger 132 shown is an external accessory, but in some examples, the plunger can be integrated with the rest of the device 100.

In some examples, the device 100 has a cap 138 sized to fit over the open end 110 of the body 106 and the open end 118 of the insert 114. When placed over the body 106, the cap 138 can prevent fluids in the device 100 from spilling out, for example, when the device 100 is being stored in a refrigerator. As discussed in more detail below, the cap 138 can be used to receive a congealed food coating (e.g., solidified butter) pushed out of the insert using the plunger 132, removed from the insert 114, and placed in storage containing the food coating for later re-use.

Figure 2:
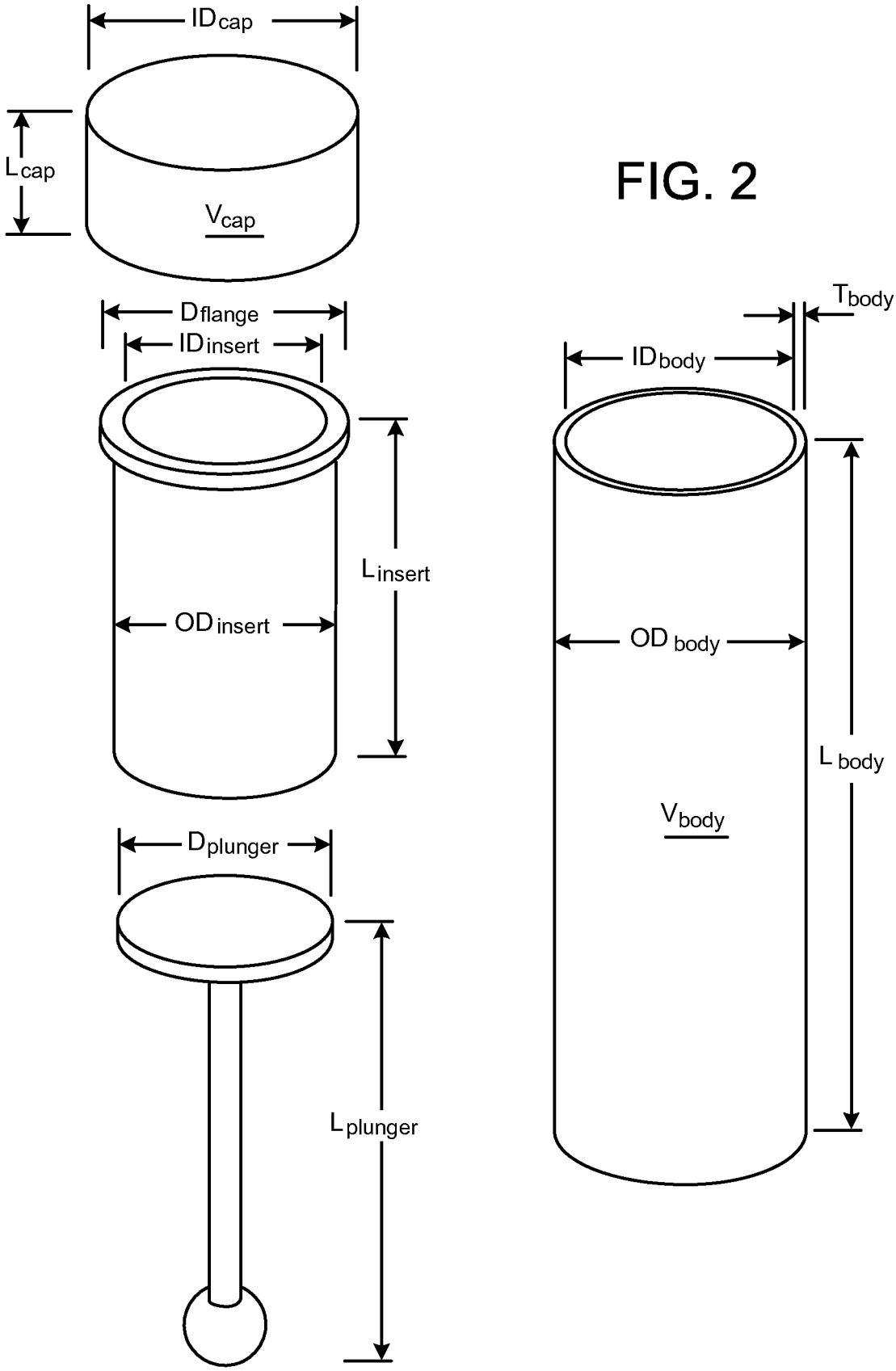
FIG. 2 shows the components of a food coating device.

FIG. 2 shows the dimensions of the elements of an embodiment of the device 100 configured for buttering an ear of corn. The body 106 is cylindrical with a length $L_{body}$, an inner diameter $ID_{body}$, a thickness $T_{body}$, and defines a volume $V_{body}$. The length $L_{body}$ is sized to be about as long as a large ear of corn so that the ear of corn can easily fit inside the body 106. In some implementations, the length $L_{body}$ is about 9.25 inches, but the $L_{body}$ for other embodiments can range between 8 and 11 inches.

The inner diameter $ID_{body}$ is sized to receive an ear of corn and the insert 114. In this embodiment, the inner diameter $ID_{body}$ is approximately 2⅝ inches.

The thickness $T_{body}$ is sufficient for the body 106 to maintain its shape and structural integrity. In this embodiment, the thickness $T_{body}$ is about 3/16ths of an inch. Depending on the material comprising the body, the thickness $T_{body}$ can range from almost zero to an inch or more.

The body 106 is sized such that the volume $V_{body}$ is sufficient to contain water, butter, and an ear of corn. In this embodiment, the body is sized to provide an interior volume of approximately 32 fluid ounces to contain 20 fluid ounces of water, 4 fluid ounces of butter and an ear of corn with a volume equivalent to the volume of no more than 8 fluid ounces of water. The volume $V_{body}$ can be much greater than 32 fluid ounces to accommodate larger volumes of water, butter, and/or a food item that is heavier/larger than an ear of corn. For example, $V_{body}$ can be 50 fluid ounces or more. As another example, $V_{body}$ can be 25 fluid ounces or less. In some examples, the volume $V_{body}$ is chosen so that the mixture of water and melted butter fills the body 106 to a height H about 6.25 inches from the bottom.

The insert 114 has a length $L_{insert}$, a flange diameter $D_{flange}$, an outer diameter $OD_{insert}$, and inner diameter $ID_{insert}$. The length $L_{insert}$ is typically less than the length $L_{body}$ of the body 106 so that the insert 114 can fit inside the body 106. In this embodiment, the insert is sized such that the length $L_{insert}$ is long enough such that the insert extends beyond the level at which butter floats inside the body 106 during use (e.g., about 5.25 inches or between 4 and 7 inches).

The flange diameter $D_{flange}$ about the same as the outer diameter $OD_{body}$ of the body 106. The flange diameter $D_{flange}$ includes the flange 122 of the insert 114 so that the flange 122 extends over at least some of the thickness $T_{body}$ of the body 106. The inner diameter $ID_{insert}$ of the insert 114 is sized to be larger than the diameter of the typical ears of corn that might be used with the device 100. The outer diameter $OD_{insert}$ of the insert 114 is less than the inner diameter $ID_{body}$ of the body 106 so that the insert 114 will fit inside the body 106. In this embodiment, $OD_{insert}$ is less than 2.63 inches (e.g., 2.62 inches, 2.5 inches, or less).

The plunger 132 has a diameter $D_{plunger}$ and a length $L_{plunger}$. The diameter $D_{plunger}$ is sized to be about the same as the inner diameter $ID_{insert}$ of the insert 114 so that the plunger 132 can fit inside the insert. If the plunger head 134 is made of a flexible material and can bend or compress, the diameter $D_{plunger}$ of the plunger can be slightly larger than the inner diameter $ID_{insert}$ of the insert 114. The length $L_{plunger}$ is sized such that the plunger 132 can be pushed through the length IL of the insert 114. In this embodiment in which the length $L_{insert}$ of the insert is 5.25 inches, $L_{plunger}$ is several inches longer (e.g., 7.25 inches or 8.25 inches), so that a user's hand gripping the plunger handle 136 does not have to enter the insert 114 during use.

The cap 138 has an inner diameter $ID_{cap}$ sufficient for the cap to fit over the insert 114 and the body 106. In this embodiment, the inner diameter $ID_{cap}$ of the cap 138 of about 3 5/32 inches. In other embodiments, the inner diameter $ID_{cap}$ of the cap 138 can be smaller or larger depending on the size of the insert 114 and the body 106. The cap 138 also has a length $L_{cap}$. In this embodiment, the length $L_{cap}$ of the cap is approximately 1.75 inches (1¾ inches). In other embodiments, the length $L_{cap}$ of the cap can be smaller or larger than 1.75 inches. In this embodiment, the cap defines an inner volume $V_{cap}$ sized to contain the butter left over from use of the device 100 after the butter has been pushed into the cap by the plunger 132. For example, the inner volume $V_{cap}$ can be between 3 and 5 fluid ounces (e.g., 4 fluid ounces).

The dimensions of the components discussed above are for an embodiment of the device 100 configured for buttering an ear of corn. These sizes depend on application and can be larger or smaller depending on the food that a particular device 100 is configured to coat.

The body 106, insert 114, plunger 132, and cap 138 are typically made of material(s) that can be washed for later re-use. For example, the material can be a dishwasher-safe material. In some implementations, the material is an ultra high molecular weight (UHMW) material such as UHMW polyethylene. In some implementations, the material is polyethylene terephthalate (PETE). Each component can be made of the same material or different materials, or some combination. For example, the body 106 can be made of one material and the insert 114 can be made of another material.

Figure 3A:
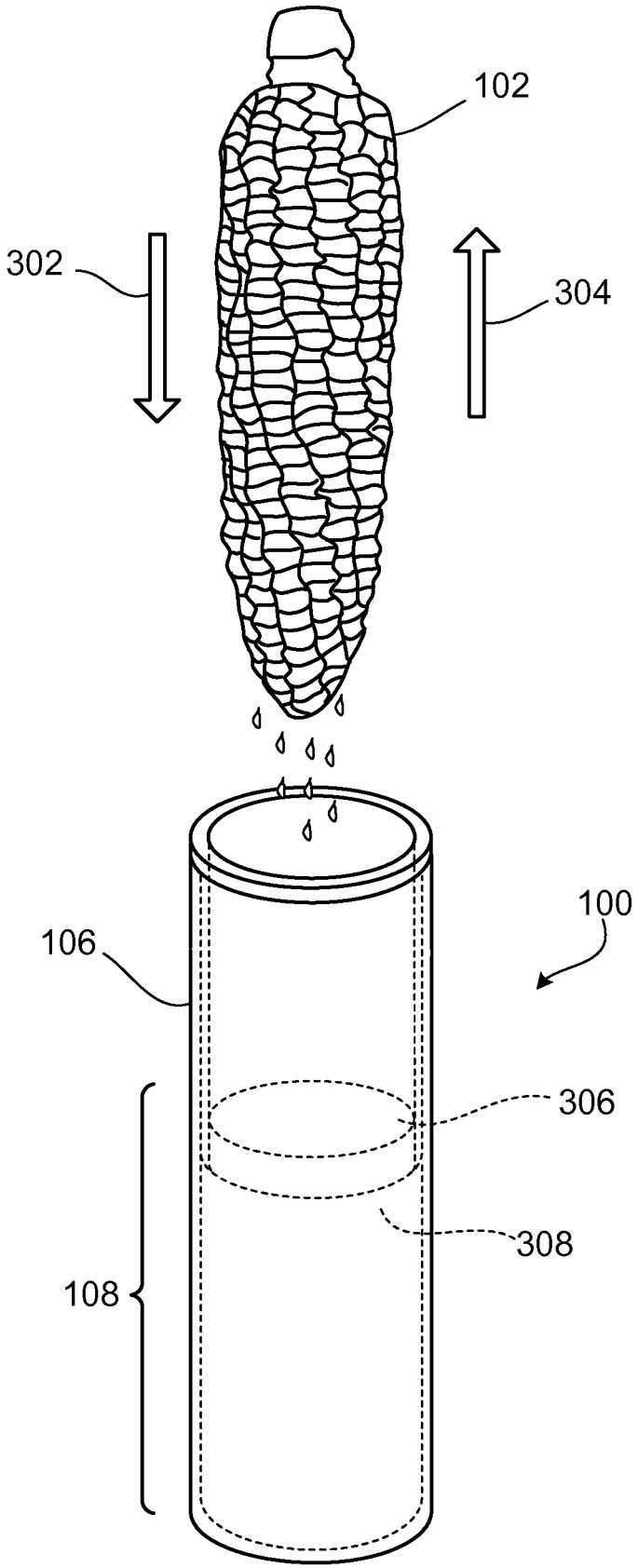
FIGS. 3A through 3E show the use of a food coating device.

As shown in FIG. 3A, a food item, in this case an ear of corn 102, can be dipped 302 into and pulled 304 out of the device 100 that contains a mixture 108 of coating (e.g., butter) and water The melted butter 306 floats atop a reservoir of water 308. When an ear of corn 102 is removed from device 100, the ear of corn retains a coating of butter, with some butter dripping back into the corn buttering device 100 for later use. Another ear of corn 102 can then be dipped 302 into the device 100, and further ears of corn can be buttered as desired. If the quantity of melted butter 306 runs low, more melted butter can be added.

Figure 3B:
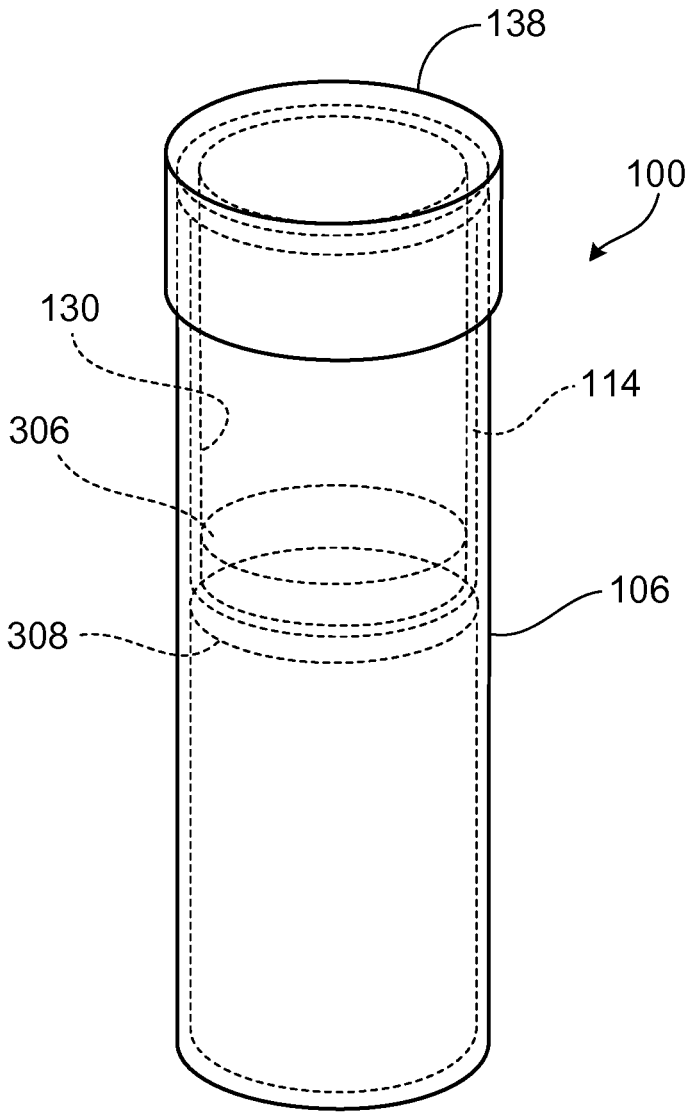

As shown in FIG. 3B, the cap 138 can be placed on the device 100 after use, reduce the likelihood of water or butter from spilling out of the corn buttering device if it is tilted to its side or knocked over. In this configuration, for example, the device 100 can be placed in a cool environment such as a refrigerator or other area at a temperature in which butter will solidify. In the cool environment, the melted butter congeals. In some examples, the solidified butter adheres to the textured inner surface 130 of the insert 114.

Figure 3C:
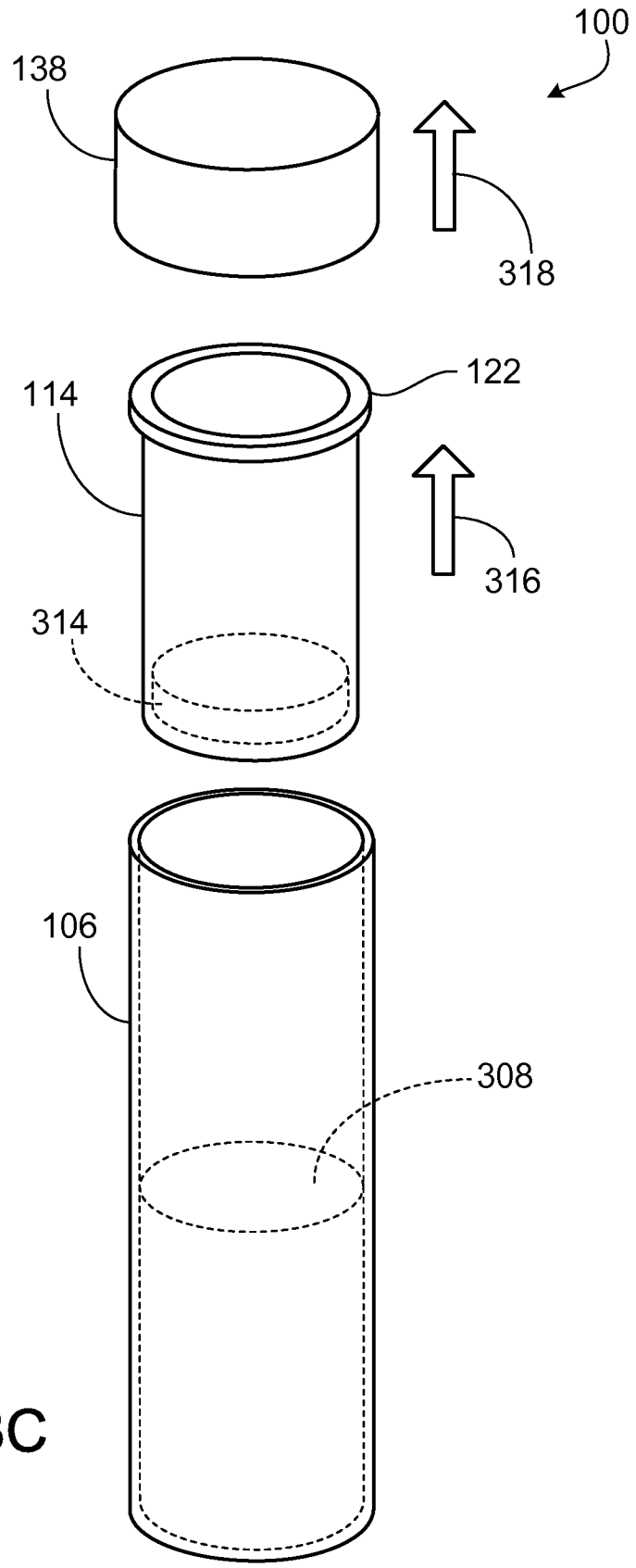

As shown in FIG. 3C, the insert 114 can be removed from the body 106 by pulling 316, for example, by gripping the flange 122 of the insert. In this example, the solidified butter 314 remains adhered to the insert 114 while the reservoir of water 308 remains inside the body 106. The cap 138 can be pulled 318 off of the device 100, or the cap 138 can remain connected to the insert 114.

Figure 3D:
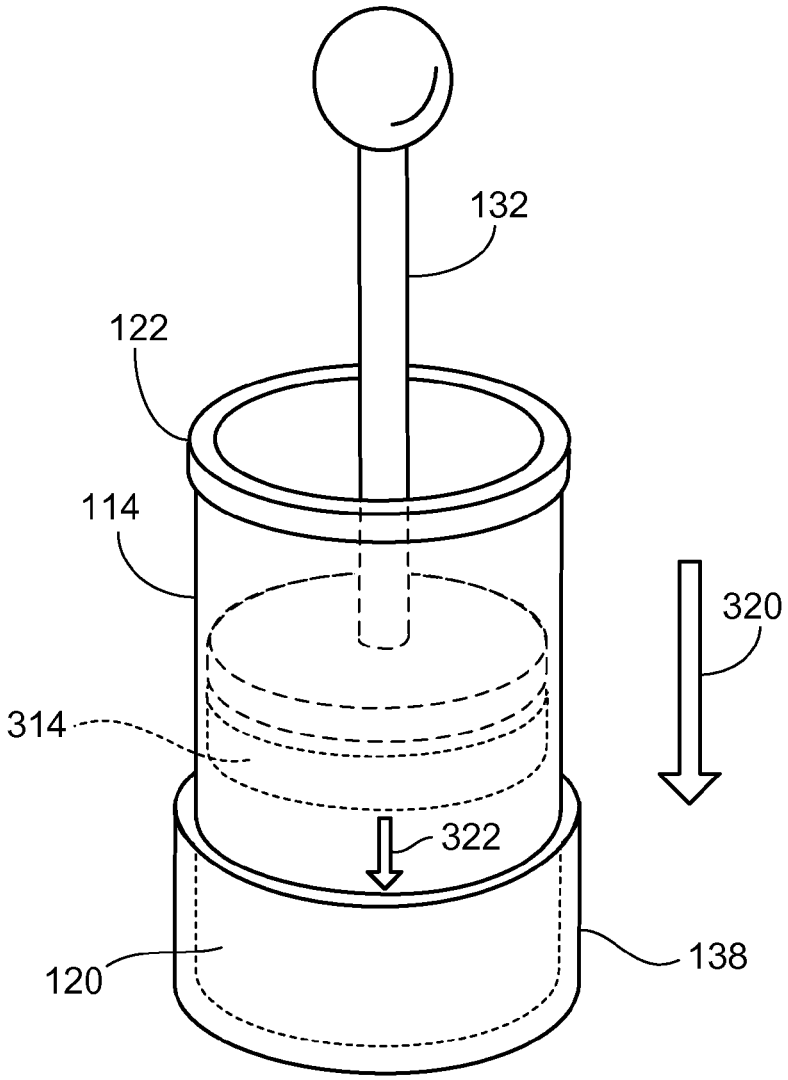

As shown in FIG. 3D, the plunger 132 can be pushed 320 into the insert 114 to push 322 the solidified butter 314 out of the insert. In some implementations, the solidified butter 314 is pushed into the cap 138 so that the butter can be stored inside the cap and re-used. In some implementations, the cap 138 is placed over the second open end 120 opposite the flange 122 of the insert 114. After use, the body 106, insert 114, plunger 132, and cap 138 can be washed and stored or used again.

Figure 3E:
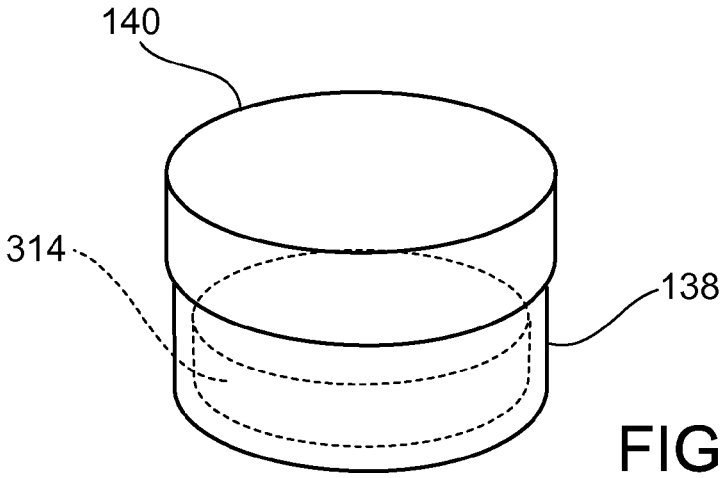

As shown in FIG. 3E, the cap 138 can be used as a butter disc holder and stored in a refrigerator or other food storage area for an extended period of time so that the butter can be re-used with the device 100 or in another food application, for example. In some embodiments, a secondary cap 140 can be placed over the cap 138 so that the solidified butter 314 is preserved for storage without being exposed to light or air that can spoil the butter.

Many other configurations of the device 100 are possible. The implementations described herein are only examples and other implementations are within the scope of the claims.

What is claimed is:

1. An apparatus for buttering corn, the apparatus comprising:

a tubular member open at the top and bottom ends thereof and sized to loosely receive an ear of corn, said tubular member having an interior surface textured to adhere to solidified butter and with said open top end having an outer flange;

a cylindrical body with an open-end having an inner diameter larger than an outer diameter of said tubular member and having an outer diameter about the same as an outer diameter of said outer flange of said tubular member, said body sized to receive said tubular member;

a plunger sized to fit through said tubular member; and a cap sized to fit over said outer flange of said tubular member.

2. The apparatus of claim 1, wherein said cap has a capacity of about 4 fluid ounces.

3. The apparatus of claim 1, wherein said cylindrical body has a capacity of about 32 fluid ounces.

4. The apparatus of claim 1, wherein said cylindrical body has a length of about 9.25 inches and said tubular member has a length of about 5.25 inches.

5. The apparatus of claim 1, wherein said cylindrical body has an inner diameter of about 2.63 inches and said tubular member has an outer diameter of less than about 2.63 inches.

6. An apparatus for coating a food item with a food coating, the apparatus comprising:

a tubular member having open top and bottom ends and sized to loosely receive a food item, said top end of said tubular member having an outer flange;

a cylindrical body with an open end and having an inner diameter larger than the outer diameter of said tubular member and having an outer diameter about the same as an outer diameter of the outer flange of said tubular member, said cylindrical body being sized to receive said tubular member; and a plunger sized to fit through said tubular member.

7. The apparatus of claim 6, wherein said tubular member comprises an interior surface textured to adhere to a food coating.

8. The apparatus of claim 6, wherein said outer flange has an outer diameter about the same as an outer diameter of said cylindrical body.

9. The apparatus of claim 6, further comprising a cap sized to fit over said open top end of said tubular member and wherein the food coating is butter.

10. The apparatus of claim 9, wherein said cap has a capacity of about 4 fluid ounces.

11. The apparatus of claim 6, wherein said tubular member comprises an ultra high molecular weight material.

12. The apparatus of claim 6, wherein said tubular member comprises a dishwasher-safe material.

13. The apparatus of claim 6, wherein said cylindrical body comprises an ultra high molecular weight material.

14. The apparatus of claim 6, wherein said cylindrical body comprises a dishwasher-safe material.

15. The apparatus of claim 6, wherein said cylindrical body has a capacity of about 32 fluid ounces.

16. The apparatus of claim 6, wherein said cylindrical body has a length of about 9.25 inches and said tubular member has a length of about 5.25 inches.

17. The apparatus of claim 6, wherein said cylindrical body has an inner diameter of about 2.63 inches and said tubular member has an outer diameter of less than about 2.63 inches.

18. An apparatus for buttering corn, the apparatus comprising:

a tubular member open at the top and bottom ends, said tubular member having predetermined inner and outer diameters, said tubular member having an interior surface textured to adhere to solidified butter, and said open top end of said tubular member having an outer flange extending outwardly from the outer surface of said tubular member;

a cylindrical body sized to receive said tubular member, said cylindrical body having an open top end and a closed bottom end, said cylindrical body having an inner diameter of approximately the same size as said predetermined outer diameter of said tubular member, said cylindrical body having an outer diameter about the same as an outer diameter of said outer flange of said tubular member;

a plunger sized to fit through said tubular member; and a cap sized to fit over said outer flange of said tubular member.

19. The apparatus of claim 18, wherein said tubular member and said cylindrical body comprise an ultra high molecular weight material.

20. The apparatus of claim 18, wherein said tubular member and said cylindrical body comprise a dishwasher-safe material.

* * * * *